United States Patent [19]

Watt et al.

[11] Patent Number: 4,695,197

[45] Date of Patent: Sep. 22, 1987

[54] ELASTOMERIC SEAL FOR A REMOVABLE BOTTOM FOUNDED STRUCTURE

[75] Inventors: Brian J. Watt, Kingwood; Dilipkumar N. Bhula, Houston; Jal N. Birdy, Kingwood, all of Tex.

[73] Assignee: Chevron Research Company, San Francisco, Calif.

[21] Appl. No.: 839,492

[22] Filed: Mar. 13, 1986

[51] Int. Cl.[4] ..... E02B 17/02

[52] U.S. Cl. ..... 405/224; 405/204; 114/296

[58] Field of Search ..... 405/203, 204, 195, 207, 405/208, 224; 114/296

[56] References Cited

U.S. PATENT DOCUMENTS

| | | | |
|---|---|---|---|
| 2,530,160 | 11/1950 | Finley . | |
| 2,657,661 | 11/1953 | Robson | 114/201 |
| 2,686,343 | 1/1951 | Harpoothian et al. . | |
| 2,720,011 | 5/1951 | Krupp . | |
| 2,937,006 | 5/1960 | Thayer | 255/2.5 |
| 3,348,517 | 10/1967 | Johnson, Jr. et al. | 114/206 |
| 3,494,136 | 2/1970 | Wilms . | |
| 3,520,543 | 7/1970 | Etter et al. | 277/205 |
| 3,701,500 | 10/1972 | Zeffer et al. | 244/103 R |
| 3,892,287 | 7/1975 | Bennett | 180/115 |
| 3,896,628 | 7/1975 | Hansen . | |
| 3,961,490 | 6/1976 | Corgnet . | |
| 4,155,671 | 5/1979 | Vos | 405/203 |
| 4,425,055 | 1/1984 | Tiedemann | 405/217 |
| 4,521,133 | 6/1985 | Suzuki et al. | 405/195 |
| 4,522,532 | 6/1985 | Fedrick | 405/195 X |
| 4,576,518 | 3/1986 | Cooke et al. | 405/203 X |

FOREIGN PATENT DOCUMENTS 2247377 6/1975 France .

OTHER PUBLICATIONS

A. Della Greca, "New Concept of Offshore Drilling/-Production Arctic Platform and Dynamic Analysis . . . ", 2/12-17/84, ASME, 1984.

Buslov et al, "Detachable Systems—Alternative Approach for Arctic Exploratory Structures", pp. 519-529.

Stenning et al, "Arctic Offshore Deepwater Ice Structure Interactions", OTC 3630, pp. 2356-2365.

G. Sebastiani et al, "Offshore Drilling and Production Platforms with Rapid Removal and Redeployment . . . ", pp. 631-642.

*Primary Examiner*—Dennis L. Taylor

*Attorney, Agent, or Firm*—E. J. Keeling; P. L. McGarrigle; V. A. Norviel

[57] ABSTRACT

The Removable Bottom Founded Structure (RBFS) is an offshore platform for petroleum drilling and producing operations intended for deployment in waters with severe weather and iceberg conditions. The structure is normally held down by gravity, but during the deballasting procedure a hold-down system is employed to keep the platform on the subbase until site evacuation. The system that is used to hold the platform down onto the subbase is located where the platform meets the subbase. It operates on the principle of hydrostatics. On the underside of the columns there are elastomeric seals that define chambers between the column and the subbase which may be evacuated by pumping. Pressure by the platform weight forces the elastomeric seals down onto the subbase to create a fluid-tight seal so that no seawater will enter the evacuated chambers. The reduction of the buoyancy forces will hold the platform onto the subbase until such time as the platform is totally deballasted. Once that has occurred, the hydrostatic hold-down system is disengaged and the platform will quickly rise to the surface.

4 Claims, 7 Drawing Figures

$P_1 = \delta \cdot h_1 \cdot A$

SIMULATED NORMAL OPERATION
HOLDDOWN SYSTEM NOT ACTIVATED $P_2 = \delta \cdot h_2 \cdot A$

SIMULATED LIFT-OFF PROCEDURE
HOLDDOWN SYSTEM ACTIVATED $\delta$ = DENSITY OF $H_2O$
$h_1, h_2$ = HEIGHT OF $H_2O$ IN A TUBE
A = AREA OF BOTTOM OF COLUMN

ELASTOMERIC SEAL FOR A REMOVABLE BOTTOM FOUNDED STRUCTURE

CROSS REFERENCE TO RELATED APPLICATIONS

This application is related to applications having the problem numbers: Ser. Nos. 869,525; 869,524; 866,825; 835,420; 835,419 and 898,989, all assigned to the assignee of this application.

FIELD OF THE INVENTION

This invention generally relates to offshore oil drilling and producing structures. More specifically, to a sealing/hold-down system that is used on a structure for removably detaching that structure from a base located on the sea floor.

BACKGROUND OF THE INVENTION

As oil exploration continues in remote locations, the use of offshore drilling techniques and structures will become more commonplace in ice-infested areas. Platforms are continually erected in isolated areas that have extremely severe weather conditions. However, the structures that operate in more temperate climates cannot usually be employed here because they must be able to cope, not only with severe arctic storms and sea ice incursions, but also with large and small icebergs that are driven by wind, current and wave action. Because of these conditions, many different types of platform designs have arisen in an attempt to cope with the harsh weather and other natural elements.

Currently, much exploration is conducted in the arctic and in the ice-infested waters off Alaska, Canada, and Greenland. To cope with the iceberg and weather problem, some structures attempt to resist these large ice masses by simply being large enough to withstand the forces from the ice features. Examples of these designs may be seen in dual cone structures, such as U.S. Pat. No. 4,245,929, large reef-like structures, or many other gravity based large concrete-steel configurations, see also U.S. Pat. No. 4,504,172. However, these structures are usually permanently affixed to the bottom. As such, they do not lend themselves to either reuse or quick site evacuation.

Another design is a tension-leg platform (TLP) with disengageable or extensible legs as described in U.S. Pat. Nos. 3,955,521 and 4,423,985. These too have their inadequacies. The TLP cannot take a substantial deck load. Furthermore, there may be problems with icebergs that have drafts large enough to scour the sea floor. Most TLP structures have exposed wellheads and anchoring systems and thus would incur substantial damage if an iceberg of this size came along. Additionally, since the platform is naturally buoyant, the tendons are under constant tension which generally shortens the life of the tie down system.

Another factor to be considered is cost. Generally, the type of large ground based structure that may be used for arctic exploration and production is very expensive and time consuming to build. With the unproven nature of some of the oil prospects, the harshness of the environment, the increased costs due to the weather down time, the probability of failure, and even the political climate, it becomes even more risky for an oil company to invest a large amount of money or time.

In the event of an accident or other type of misadventure, losses could be greatly multiplied.

To overcome many of the disadvantages of these previously discussed arctic structures, it would be advantageous to combine some of the principles of the gravity-based structures with those of the floating structures. This is accomplished by constructing a platform that has subsurface hull chambers that may alternatively provide buoyancy and ballast. This structure may be floated to a drilling or production site and slowly filled with ballast until it rests on the sea floor. When a situation, threatening to the structure, presents itself, the platform may be deballasted and removed from the site. However, this deballasting procedure is quite slow (on the order of 6 to 7 hours) and since it will possibly be done in rough seas, there is a chance that the structure may be damaged when it "bounces around" during its slow ascent.

To minimize this problem, a sudden and rapid ascent is required. This means that it is necessary to keep the platform on location down with a hold-down means while it is deballasting. Once it has been fully deballasted, the hold-down means may then be released to allow the platform to quickly ascend to the surface and escape damage.

This hold-down system may be mechanical or hydraulic, however, because a mechanical system will be subject to a high degree of tension just prior to release, and may not assure a simultaneous release of all mechanical systems, a hydrostatic sealing system is chosen. This hydrostatic system will hold the structure to the base from the beginning of the deballasting procedure to the time when deballasting is complete. When this occurs, the structure may be quickly detached by releasing the seal and then floated away from the impending danger.

To eliminate most of the problems of these previously-mentioned arctic structures for use in ice-infested waters, the Removable Bottom Founded Structure (RBFS) was developed to provide a platform which may be removably detached from its base with the help of the aforementioned seals and, if necessary, transported to a safer location.

SUMMARY OF THE INVENTION

The present invention holds a buoyant platform onto a subbase that rests on the sea floor. The platform is called a Removable Bottom Founded Structure (RBFS) and it is designed for the arctic environment. The RBFS resembles a very large submersible drilling platform which, by virtue of its direct access to the wells, functions in many ways like a conventional fixed drilling and production platform. Normally the platform would be fully ballasted on the subbase with a combination of water and solid ballast. However, in the event of an approaching iceberg larger than one which the RBFS is designed to resist, the sealing system is engaged, the platform is deballasted to a positive buoyancy condition and the risers are disconnected from the subbase so that the platform may be floated and propelled off location to leave the subbase behind. In this design environment, the platform must disconnect from the subbase and reach its floating draft very quickly to avoid potential collision between the platform and subbase. Here, the hold-down system keeps the platform down on the subbase, the platform is deballasted to achieve a large net buoyant upward force, and the hold-down mechanism is quickly released to lift off the platform.

To provide an appropriate sealing mechanism, an elastomeric seal is installed on the underside of the platform. Once the platform rests on the subbase and compresses the elastomeric seal, the volume defined by: the seal, the platform, and the subbase, is evacuated to reduce the hydrostatic head under the RBFS and to keep the platform on location. The platform stays in place during this time by effectively removing the buoyancy forces from the underside of the columns; thus, the platform alone holds itself down as if it were not resting on water. The platform may be removed once the differential pressure between the area defined by the seal and the outside environment is removed.

DETAILED DESCRIPTION OF THE INVENTION

The Removable Bottom Founded Structure (RBFS) is an offshore structure for petroleum drilling and producing operations and is intended for deployment in waters with severe weather and iceberg conditions. The RBFS is a two-part structure. The first part generally comprises a platform and is made up of multiples columns which are affixed to a deck structure. The second component is a reinforced concrete subbase that rests on the sea floor and upon which platform is founded.

The RBFS is designed to withstand severe conditions of wind, wave and current action, and many of those ice conditions which could normally be expected during the structure's life. For example, the RBFS was designed to withstand a 150-year return period storm; an iceberg with a 20-year return period kinetic energy; and to survive (with some damage) an impact with an iceberg having a 100-year return period kinetic energy. However, if an iceberg large enough to cause damage to the RBFS threatens to come in contact with the structure, the platform may be evacuated from the site, to leave the subbase behind. To ensure that the inhabitants and operators of the RBFS are apprized of all iceberg and storm dangers, they maintain visual lookouts for good days and shorter distances whereas they use a radar system for longer distances and less clear weather. Danger zones, having specified radii, may also be established to allow the platform personnel to gauge the possibility of actual iceberg incursion.

Figure 1:
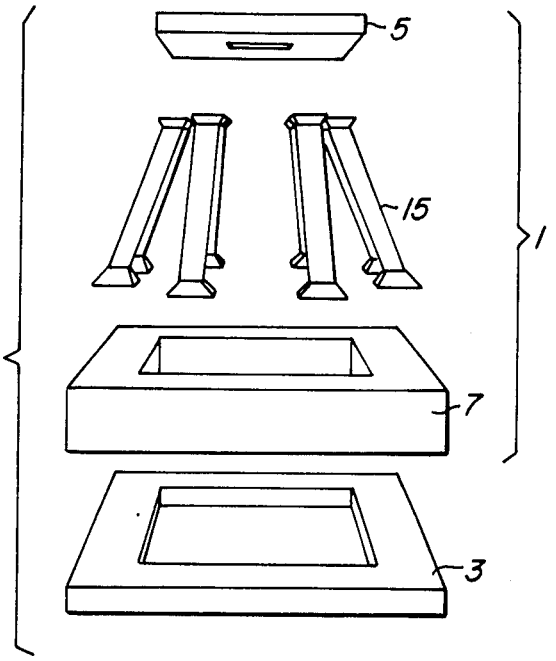
FIG. 1 is an exploded view of the platform and subbase.
Figure 1A:
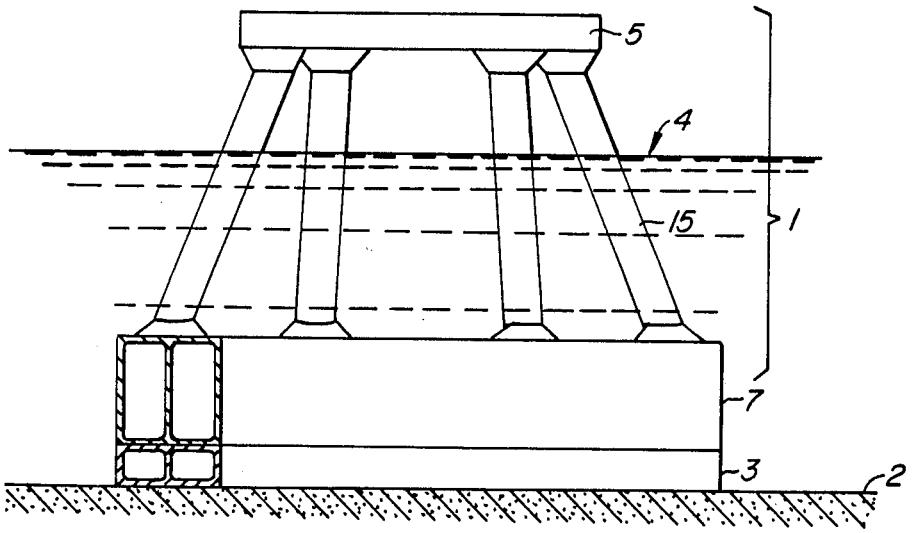
FIG. 1A is a view of the assembled platform resting on the subbase.

FIGS. 1 and 1A show that the RBFS comprises two portions, a platform 1 and a subbase 3. The platform 1 is composed of a deck 5, columns 15, and a pontoon 7. The subbase 3 is affixed to the sea floor 2 to keep the deck 5 above the water surface 4 and provides a surface to receive axial and lateral loads from the platform 1.

Figure 2:
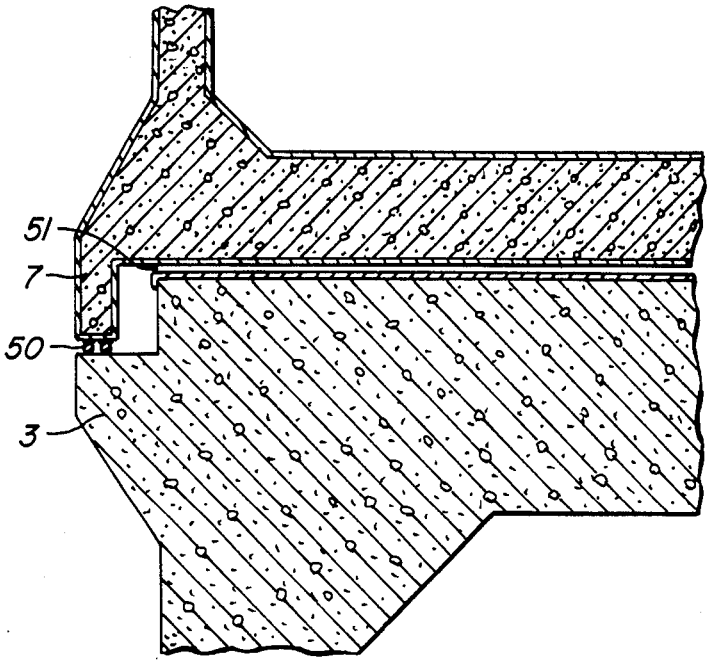
FIG. 2 is a cross-sectional view of the lower portion of the pontoon and the subbase showing the sealing system.

The subbase 3 is a permanent reinforced concrete structure. It is shown in FIGS. 1, 1A and 2. The subbase 3 is designed to withstand a 100-year iceberg impact with practically no movement and no structural damage and is able to survive a 2000-year iceberg with limited damage. The subbase 3 provides a bearing surface for vertical and lateral load transfer from the platform 1 and protects a subsea drilling template from iceberg scour.

To prevent potential collision between the platform 1 and the subbase 3 during an iceberg avoidance operation, the platform 1 must rise quickly to its floating draft, otherwise the platform 1 may strike the subbase 3 during lift-off. Furthermore, to shorten the overall iceberg avoidance procedure, the platform 1 must be deballasted concurrently with other iceberg avoidance operations such as shutting in wells and purging and disconnecting the risers. To hold the platform 1 onto the subbase 3 while deballasting (and becoming more buoyant) the hydrostatic pressure that acts under the platform 1 must be reduced. To accomplish this, a system of seals enclose the perimeter of the base of the pontoon 7. After a space 51 bordered by this system of: seals; the pontoon 7; and the subbase 3; is shut off from the outside seawater, the hold-down system is activated. This reduces the hydrostatic pressure acting on the bottom of the pontoon 7 and will effectively hold the platform 1 on the subbase 3.

Figure 5:
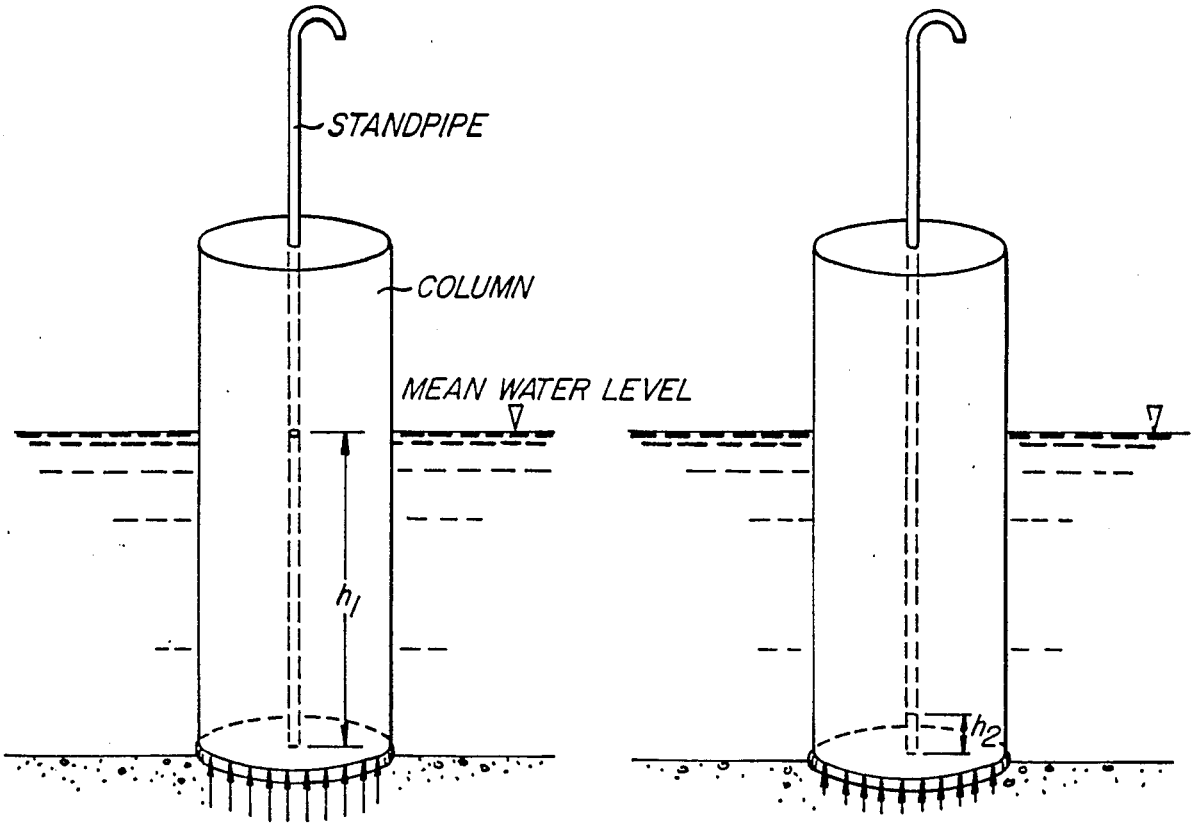
FIG. 5 represents of the forces that act on the underside of a buoyant column.

The hydrostatic hold-down system operates by reducing the hydrostatic head on the area underneath the pontoon 7. FIG. 5 represents the buoyancy forces acting on a hypothetical column before and after the sealing system is engaged. In normal states, the buoyant force that acts on a column may be shown by $P_1=\delta \cdot h_1 \cdot A$ where $P_1$ is the total buoyant force, $\delta$ is the density of water, $h_1$ is the height of water in the standpipe, and A is the area underneath the column. However, operation of the hold-down system reduces the water level in the standpipe to $h_2$. This decreases the buoyant force to a new value which can be expressed as $P_2=\delta \cdot h_2 \cdot A$. As a result, the hold-down system maintains a difference in hydrostatic pressure between the outside environment and the area underneath the column as long as it is engaged.

Figure 2A:
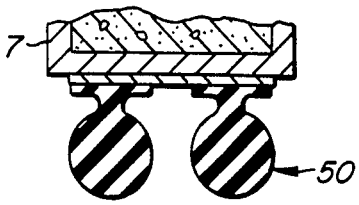
FIG. 2*a* is an enlarged view of the sealing system.

FIGS. 2 and 2*a* show the seals for the hold-down system. A redundant set of seals 50, arranged on the underside of the pontoon 7, enclose a hold-down chamber 51 between the pontoon 7 and the subbase 3. During normal platform operation the RBFS behaves as a gravity structure. Because a suction hold-down force is not needed, the chamber 51 is open to the ambient hydrostatic pressure. As the platform 1 is deballasted and becomes more buoyant, the hydrostatic pressure in the chamber 51 is reduced by withdrawing water from the chamber 51 to create a hold-down force. The hold-down force equals the product of the plan area of the chamber 51 and the differential pressure in the chamber 51, which is $\Delta P=\delta(h_1-h_2)$ (the differential pressure is the ambient hydrostatic pressure at the top of the subbase 3 less the pressure in the chamber 51 which corresponds to the water level in the chamber 51). The hold-down force on the pontoon 7 is sufficient to prevent uplifting of the platform 1 under the combined effects of the buoyancy of the deballasted platform 1 and the design storm loads. The hold-down force is deactivated by opening the chamber 51 to the ambient hydrostatic pressure.

Figure 4:
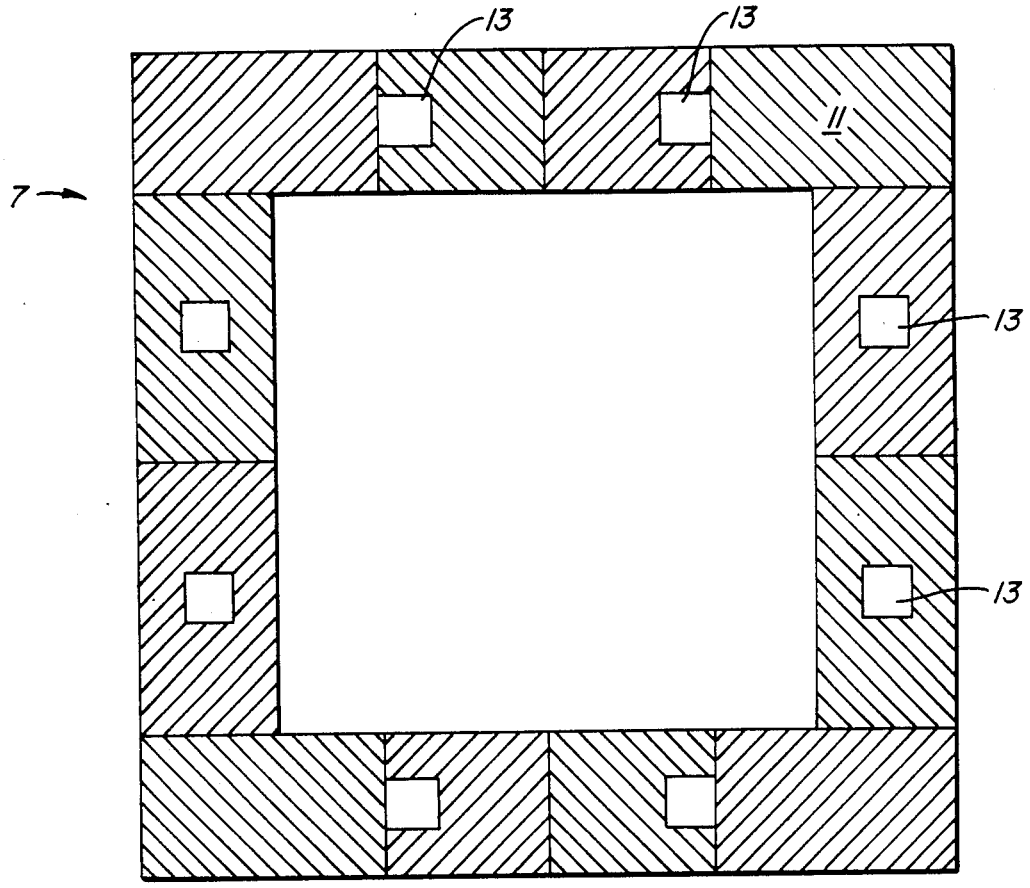
FIG. 4 is a view of the underside of the pontoon and its associated sealing chambers.

FIG. 2*a* shows the seals 50 that create a fluidtight barrier between the area underneath the pontoon, i.e., the chamber 51 and the outside environment. They are "O-Ring" type seals and are vulcanized, solid rubber gaskets. The seals 50 occur in a redundant fashion to ensure that there is a proper barrier, and they are compressed directly onto the top slab of the subbase 3 (by the platform weight) when they are in the operating mode. FIG. 4 is a view of the bottom of the pontoon 7 and shows that the seals 50 divide the chamber 51 in the underside of the pontoon 7 into twelve smaller compartments 11. Each compartment 11 is serviced by a pump room 13.

Figure 3:
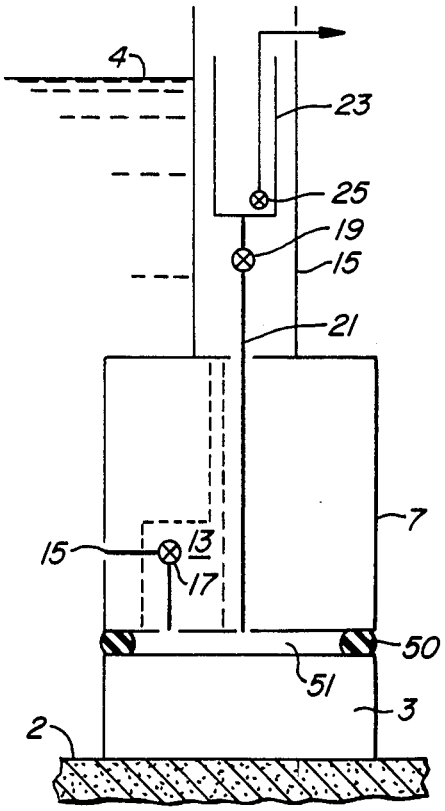
FIG. 3 is a schematic diagram of the hydraulic suction control system.

FIG. 3 schematically illustrates the nature of the dewatering control system. The pontoon 7 is set onto the subbase 3 when the platform 1 is deballasted. The redundant seals 50 divide the chamber 51 into smaller compartments 11 in the underside of the pontoon 7 and the seal compression creates a fluid-tight barrier between each compartment 11 and the outside environment. A pump room 13 connects the compartments 11 with the outside seawater by pump vent lines 15 and a pump 17. The compartment 11 also communicates with an evacuation pump 19 by a header line 21. The header line 21 further communicates with a surge tank 23 which has a stripping pump 25.

The evacuation system shown in FIG. 3 relies on a hold-down force due to a differential in the hydrostatic head between the chamber 51 (more specifically, each compartment) and the external environment. This differential is achieved by pumping out the required amount of water in a stand pipe system connected to the chamber 51. The stand pipe system is made up of the header line 21, the evacuation pump 19, the surge tank 23, and the stripping pump 25. To create a hold-down force, the procedure is to pump water out of the chamber 51 by the evacuation pump 19 through the header pipe 19 until the difference in the hydrostatic head across the seals 50 is sufficient to keep the platform 1 on location. If there is a sufficient amount of leakage past the seals 50 then something akin to a float valve may be used to reactivate the pumping system to continue to control the pressure head in the chamber 51. In the event that the platform 1 must lift off from the subbase 3 the pump room pump 17 may draw water in from the external environment via the vent line 15 to fill up the space 51. This would destroy the difference in the hydrostatic head and the platform 1 would no longer be held to the subbase 3. It would rapidly rise to the surface.

Operation of the hydrostatic hold-down system is not necessary for the RBFS during normal operating conditions (because it is normally held in place by gravity), however, the seals 50 would be frequently tested for leaks. Prior to evacuation the seals 50 would be engaged, and the platform 1 would be deballasted by pumping out some ballast chambers. These evacuation pumps are sized such that the entire platform 1 can be deballasted in five hours. Redundant control of ballast tanks from several independent pumps is designed into the system, and ballast control is fully automated with manual backup.

If the seals 50 are effective, then all the water in the chamber 51 will be removed. A float valve (not shown) may be used to turn off a pump when the desired water level is reached and may reactivate the pump in the event of water leakage into the space 51. While the platform 1 is being fully deballasted and the seals 50 have been engaged, the various mechanical systems are prepared for liftoff.

Since the RBFS is intended to evacuate the site on impending impact of a large iceberg, all piping and control lines between the platform 1 and subbase 3 are readily disconnectable. (None of the following material is illustrated.) Therefore, the next step before site evacuation is to hydraulically disengage the riser mechanical latching system to lift the entire integrated riser bundle upward into the column 15 by means of hydraulic hoists. The production and injection wells and oil sales lines are shut in subsea and all lines in the integrated riser are purged with seawater. This is the final preparatory step in the liftoff procedure.

Immediately after the platform 1 lifts off the subbase 3, the platform 1 moves away under positive navigational control achieved with a thruster system built into the platform 1 (not shown). The thruster system is designed to steer the platform 1 in a controlled manner, but not to keep station. Tugs in the vicinity (for iceberg towing, surveillance and other purposes) provide further steering control once sea conditions permit attachment of towing lines.

When sea and ice conditions again permit, the platform 1 is resited on subbase 3 and the platform 1 is reballasted. The integrated riser bundle (this system is not shown) is stabbed into its receptacle in the subbase 3, hydraulic hoists are used to stab a riser connector down onto a connector mandrel, and an integrated riser is reconnected to the wellhead. Drilling risers (also not shown) are also reattached to a well template through a moon-pool and the normal operations are again resumed.

Since many modifications and variations of the present invention are possible within the spirit of this disclosure, it is intended that the embodiments disclosed are only illustrative and not restrictive. For that reason, reference is made to the following claims rather than to the specific description to indicate the scope of this invention.

What is claimed is:

1. A sealing apparatus to affix a gravity founded, movable offshore structure onto a subbase that rests on the sea floor, during the time when the movable structure is being deballasted to prepare for rapid site removal, comprising:

a movable offshore platform;

at least one load bearing member to support the platform, the member is fixedly connected to the platform and extending in a generally downward direction from the platform;

a generally flat surface on the underside of the member;

a subbase also located on the sea floor to provide support to the platform;

a generally flat upper surface on the subbase to support the member on the upper surface of the subbase;

means for creating a space between the subbase and the member;

a passive, elastomeric seal on the bottom of the at least one load bearing member and mounted on a lip for sealing purposes, the seal being engaged once a portion of the platform weight forces the elastomeric seal down onto the subbase to establish a fluid-tight barrier around the space; and means for evacuating the space between the subbase, the member and the elastomeric seal to reduce the hydrostatic pressure to a lower pressure than the surrounding seawater, so that when the space has been evacuated the platform remains on the subbase while it is being deballasted until such time when the hydrostatic pressure in the evacuated space has been restored to equilibrium with the outside sea environment.

2. The sealing apparatus as recited in claim 1 wherein the load bearing member is a pontoon that is shaped as a rectangle and upon which the platform is supported by a plurality of columns.

3. The sealing apparatus as recited in claim 1 wherein the means to evacuate the space comprises:

a header pipe in fluid communication with the space that is defined by the subbase, the member, and the passive elastomeric seal;

a first pump in fluid communication with the header pipe;

a surge tank in fluid communication with the first pump;

a stripping pump in fluid communication with the surge tank; and a vent line in fluid communication with both the space and the ambient seawater.

4. The apparatus as recited in claim 2 wherein the platform is supported by a plurality of columns that are battered and which are rigidly connected to the upper surface of the pontoon.

* * * * *